US008607368B2

(12) United States Patent
Huang et al.

(10) Patent No.: US 8,607,368 B2
(45) Date of Patent: Dec. 17, 2013

(54) CONNECTION DEVICE BETWEEN TOILET AND DRAINPIPE

(75) Inventors: Jim Huang, Shanghai (CN); Jarl Jiang, Shanghai (CN); Daniel Xia, Shanghai (CN); Daniel Owen Karraker, Dongola, IL (US)

(73) Assignee: Kohler (China) Investment Co., Ltd., Shanghai (CN)

( * ) Notice: Subject to any disclaimer, the term of this patent is extended or adjusted under 35 U.S.C. 154(b) by 222 days.

(21) Appl. No.: 12/427,081

(22) Filed: Apr. 21, 2009

(65) Prior Publication Data

US 2009/0320196 A1 Dec. 31, 2009

(30) Foreign Application Priority Data

Apr. 21, 2008 (CN) ..... 2008 2 0057531 U

(51) Int. Cl.
*E03D 11/00* (2006.01)
*F16L 11/12* (2006.01)

(52) U.S. Cl.
USPC ..... 4/252.1; 4/252.5; 4/252.6; 285/56

(58) Field of Classification Search
USPC ..... 4/252.1, 252.2, 252.3, 252.4, 252.5, 4/252.6, 421, 422, 424, 425, 430, 428, 4/DIG. 7, DIG. 9; 285/56, 57, 58, 59, 60, 285/148.22, 298, 915, 3, 93, 179, 226, 299
See application file for complete search history.

(56) References Cited

U.S. PATENT DOCUMENTS 1,183,893 A * 5/1916 Mann ..... 4/421
1,242,572 A * 10/1917 Mann ..... 4/252.2
1,389,004 A * 8/1921 Johnston ..... 285/58
3,015,501 A * 1/1962 Minella ..... 285/58
3,521,913 A * 7/1970 Verhein et al. ..... 285/109
4,171,548 A * 10/1979 Wilson ..... 4/421
4,497,511 A * 2/1985 Barker ..... 285/136.1
5,819,326 A * 10/1998 Kobayashi et al. ..... 4/252.1
5,926,863 A * 7/1999 Arita et al. ..... 4/425
6,108,826 A * 8/2000 Hayashi et al. ..... 4/252.1
6,195,810 B1 * 3/2001 Minamiyama et al. ..... 4/420
6,464,259 B1 * 10/2002 Kramer ..... 285/56
8,141,177 B1 * 3/2012 Majocka et al. ..... 4/252.3

FOREIGN PATENT DOCUMENTS

CN 1145649 A 3/1997
EP 553657 A1 * 8/1993 ..... E03D 11/13

* cited by examiner

*Primary Examiner* — Brian Glessner
*Assistant Examiner* — Joseph J Sadlon
(74) *Attorney, Agent, or Firm* — Foley & Lardner LLP

(57) ABSTRACT

This is a type of connection device between a toilet and a drainpipe, including a trap with an inlet connected to a toilet flush port and an outlet connected to the drainpipe. The trap has a bend part and a horizontal lower pipe connected to it. Upper and lower inner pipe walls of the horizontal lower pipe have different declination angles. There is a containing part in the inlet; and in the containing part there is a sealing part forming a sealing structure between the flush port and the inlet. This simplifies the complex structure of existing toilet drainage parts for on-site installation and for reliable use. The separated trap design includes structure that can generate a siphon phenomenon. At the time of sale, wash-down drainage can be easily transformed to siphon wash-down drainage just by changing parts, such as the trap of the toilet, thus improving the drainage effect.

22 Claims, 4 Drawing Sheets

A-A

CONNECTION DEVICE BETWEEN TOILET AND DRAINPIPE

BACKGROUND

The present application relates to sanitary ware and a connection device between a toilet and a drainpipe.

Toilets available in the market can be divided into siphon drainage toilets and wash-down drainage toilets. For siphon drainage toilets, under normal atmospheric pressure, water rapidly fills the drainage pipe, forms a difference in fluid column height, generates pressure, makes the liquid flow from the high level with high pressure to the low level with low pressure, generates a siphon phenomenon, and drains the ordure out of the toilet drainage pipe; and it features water saving, silence and completely washed effect. Wash-down drainage toilets use the maximum potential energy of the effective water volume at fastest flow speed and at maximum flow to cover the ordure and drain it out; it tends to be eliminated due to high noise, water waste and poor odor sealing function. But for large production volume, there are still some wash-down toilets in the market.

One existing toilet installation method is to mount the drainage port at the bottom of the toilet on a special flange fixed on the top end of the drainpipe in the building, and then a sealing method is used to connect these two parts. For example, China Invention Patent Announcement (No. CN 1085763 C) describes a toilet installation method that uses a flush connection pipe (6), a drainage connection pipe (7) and a connection pipe (8) between these two pipes; the length of the connection pipe (8) has to be adjusted by the user on the site, the overall connection structure is complex, and it may cause pollution if the pipe is not sealed well.

To sum up, the connection method of existing toilets has the above-mentioned disadvantages, such that wash-down drainage toilets tend not to be used, but there are still many wash-down toilets in the market. It would be advantageous to design an easy-to-install connection device that can transform existing toilets from wash-down drainage to siphon wash-down drainage.

The concepts discussed in the present application are designed to overcome the defects of existing wash-down toilets, such as poor drainage effect and complex connection with a drainage pipe of a building, and to provide an easy-to-install connection device that can transform an existing toilet from wash-down drainage to siphon wash-down drainage.

To realize this purpose, a connection device between a toilet and a drainpipe includes a trap with an inlet connected to a toilet flush port and an outlet connected to the drainpipe. The trap has a bend part and a horizontal lower pipe connected to it. Upper and lower inner pipe walls of the horizontal lower pipe have different declination angles. There is radius-increased part at the inlet; in the radius-increased part, there is sealing part forming a sealing structure between the flush port, which is connected to the radius-increased part with a fixing part.

Compared to existing technologies, this configuration simplifies the complex structure of existing toilet drainage parts for on-site installation, and for easy and reliable use; the separated trap design features structure that can generate siphon phenomenon. At the time of sale, wash-down drainage can be easily transformed to siphon wash-down drainage just by changing parts, such as the trap of the toilet, when requested by the user, to improve the drainage effect.

These concepts are further described with the following drawings and examples.

SUMMARY

According to an exemplary embodiment, a connecting apparatus for making a connection between a flushing port and a drainpipe generally includes a trap-way piece. The trap-way piece includes an entrance and an exit. The entrance is configured to be in fluid communication with the flushing port. The exit is configured to be in fluid communication with the drainpipe. The trap-way piece includes a curved pipe portion and a transverse low pipe portion connected therewith. The entrance comprises a flange containing cavity configured to be connected and held together with the flushing port by a washer that is configured to be compressed by an elongated fastener.

According to an exemplary embodiment, a device for connecting a toilet to a drainpipe generally includes a trap, a cavity, a washer, a washer cover, and a threaded fastener. The trap includes an inlet and an outlet. The cavity is coupled to the trap proximate the inlet. The washer comprises an elastic material. The cavity is configured to receive at least a portion of the washer. The washer is configured to receive at least a portion of the flush port of the toilet. The washer cover is configured to be pressed by the threaded fastener against the washer to seal a connection between the trap and the flush port.

DETAILED DESCRIPTION

Figure 1:
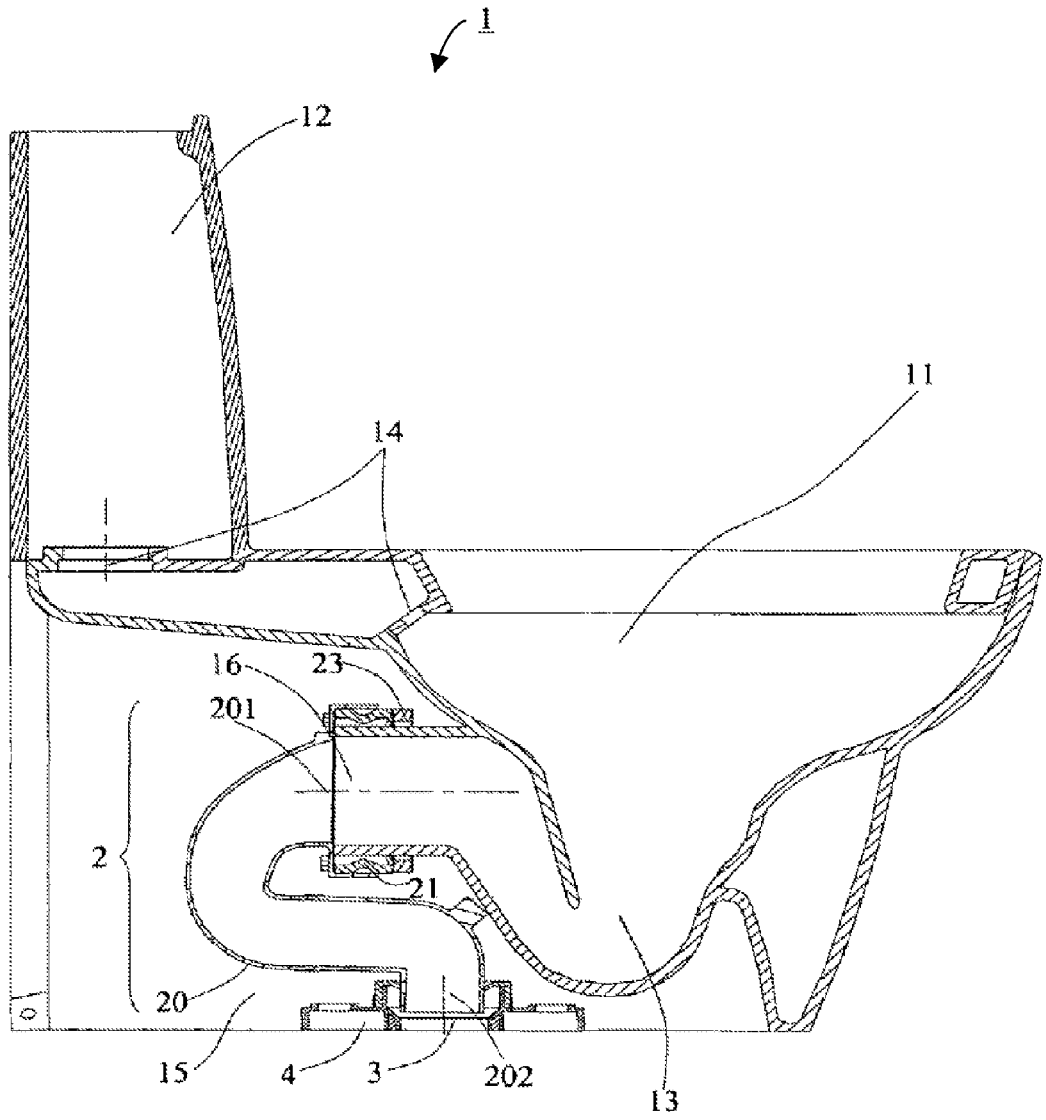
FIG. 1 is a vertical cross section drawing of a toilet using a connection device.

FIG. 1 is a vertical cross section drawing of an optimal implementation example, toilet 1, using a connection device 2 between a toilet and a drainpipe. Besides the connection device 2, the toilet 1 can be of any suitable type, such as the wash-down drainage toilet 1, which includes a bowl 11 and a tank 12 over the back of the bowl 11. The tank 12 is filled with clear water to the flush bowl 11. A curved channel 13 is formed below the bowl 11, with a shape similar to an upside-down "U". There is a backward flush port 16 at the end of the curved channel 13. The clear water in tank 12 flows through a waterway 14 to the bowl 11. A supporting part 15 is formed at the bottom of bowl 11.

An existing floor flange 4 for connecting the toilet 1 is at the top end of a drainpipe 3, and the floor flange 4 is pre-installed during building construction. For the existing floor flange 4, the connection device 2 between a toilet and a drainpipe can also be used.

Figure 2:
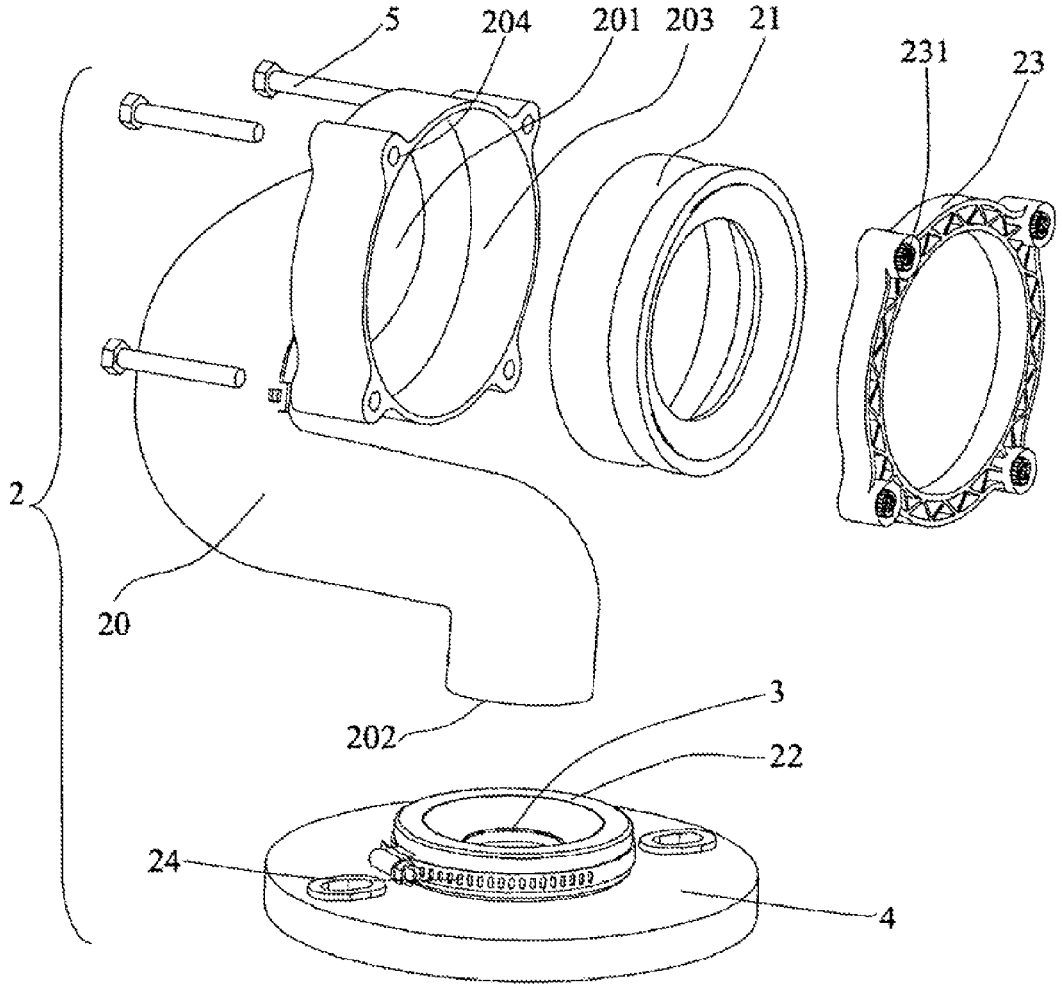
FIG. 2 is an exploded drawing of a floor flange and a connection device between a toilet and a drainpipe.
Figure 3:
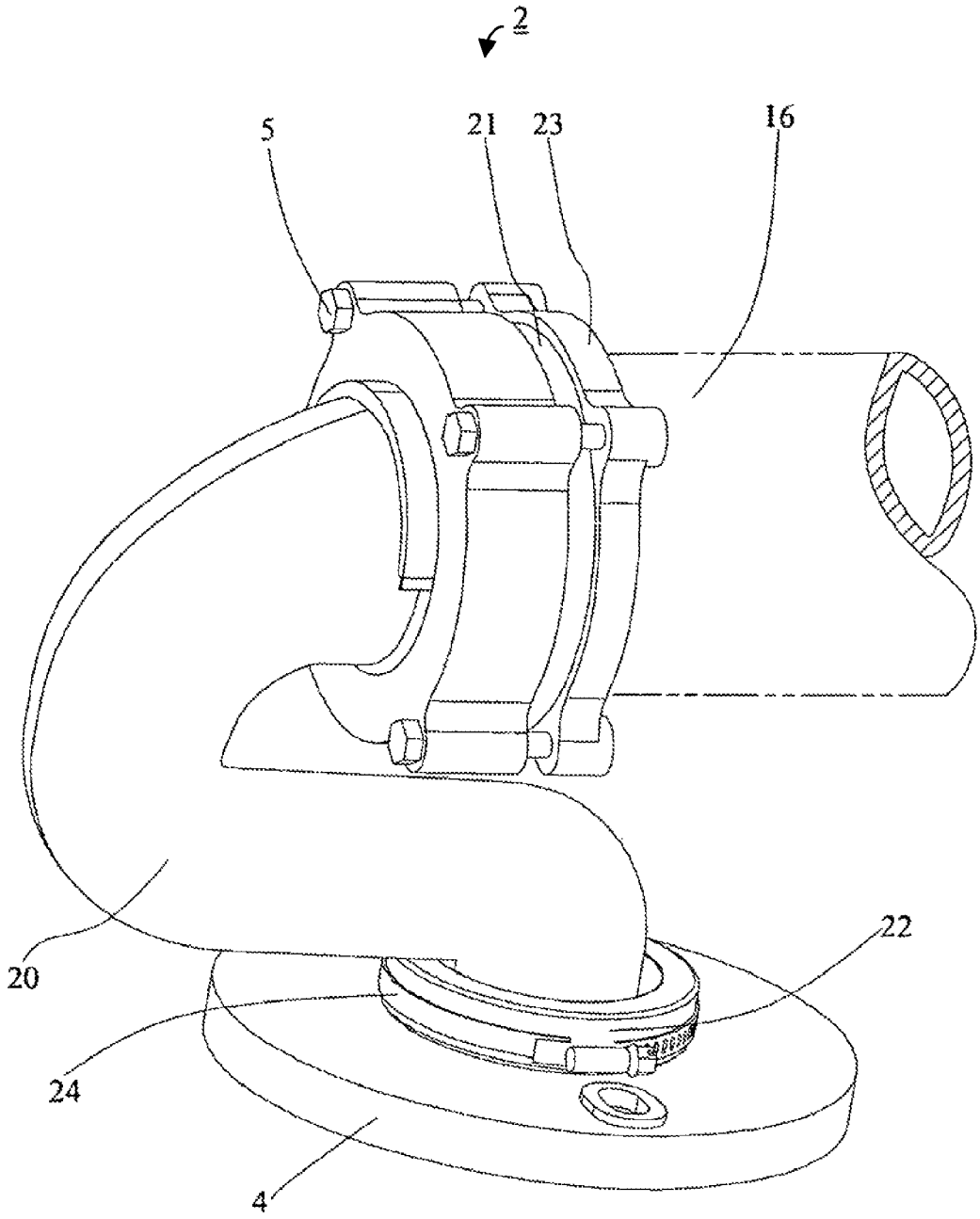
FIG. 3 is an assembly drawing of a connection device between a toilet and a drainpipe.

FIG. 2 and FIG. 3 are an exploded drawing and an assembly drawing of the connection device 2 between a toilet and a drainpipe, respectively. The connection device 2 between a toilet and a drainpipe includes a trap 20, washer 21, sealing ring 22, washer cover 23 and sealing ring cover 24.

The trap 20 is curved, with an inlet 201 and an outlet 202. An integrated flange containing cavity 203 is connected to the end of the inlet 201; the washer 21 is inside the flange containing cavity 203; the sealing ring 22 is fitted to the part of drainpipe 3 standing out of the floor flange 4; the sealing ring cover 24 is fitted to and fixes the sealing ring 22; and, the sealing ring cover 24 and the sealing ring 22 are fitted tightly.

Figure 5:
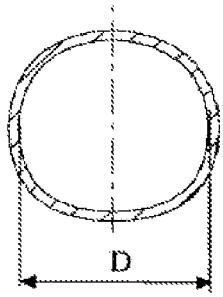
FIG. 5 is a section drawing of A-A line in FIG. 4.

See FIG. 1 and FIG. 5. At the time of installation, the inlet 201 is connected to the flush port 16 of the toilet 1; the washer cover 23 covers the washer 21 and is between the flange containing cavity 203 and the toilet 1; the flush port 16 is connected to the inlet 201 of the trap 20 through the washer cover 23, the washer 21 and the flange containing cavity 203; the bolt 5 connects the trap 20, the washer 21 and the washer cover 23 through the flange containing cavity 203 and screw holes 204 and 231 around the washer cover 23. The washer 21 is made of elastic material, with an inner diameter slightly smaller than or basically equal to an outer diameter of the flush port 16, thus the washer 21 is fitted tightly with an outer pipe wall of the flush port 16 and seals the connection position between the trap 20 and the flush port 16. In addition, with the bolt 5, the washer cover 23 is pressed on the washer 21 to make the sealing effect more reliable.

The sealing ring 22, also made of elastic material, is fitted tightly with the floor flange 4 connected to the drainpipe 3, and is fitted to the outside of the sealing ring 22 with the sealing ring cover 24, further ensuring the reliability of connection and sealing. The inner diameter of the sealing ring 22 is slightly smaller than or basically equal to the outer diameter of the outlet 202. At the time of installation, the outlet 202 is connected to the drainpipe 3 just by connecting the trap 20 to the toilet 1 and inserting one end of the outlet 202 directly to the drainpipe 3 through the sealing ring cover 24, the sealing ring 22 and the floor flange 4. The sealing ring 22 is fitted tightly to the outer pipe wall of the outlet 202. The sealing ring cover 24 is fitted to make the sealing effect more reliable.

Figure 4:
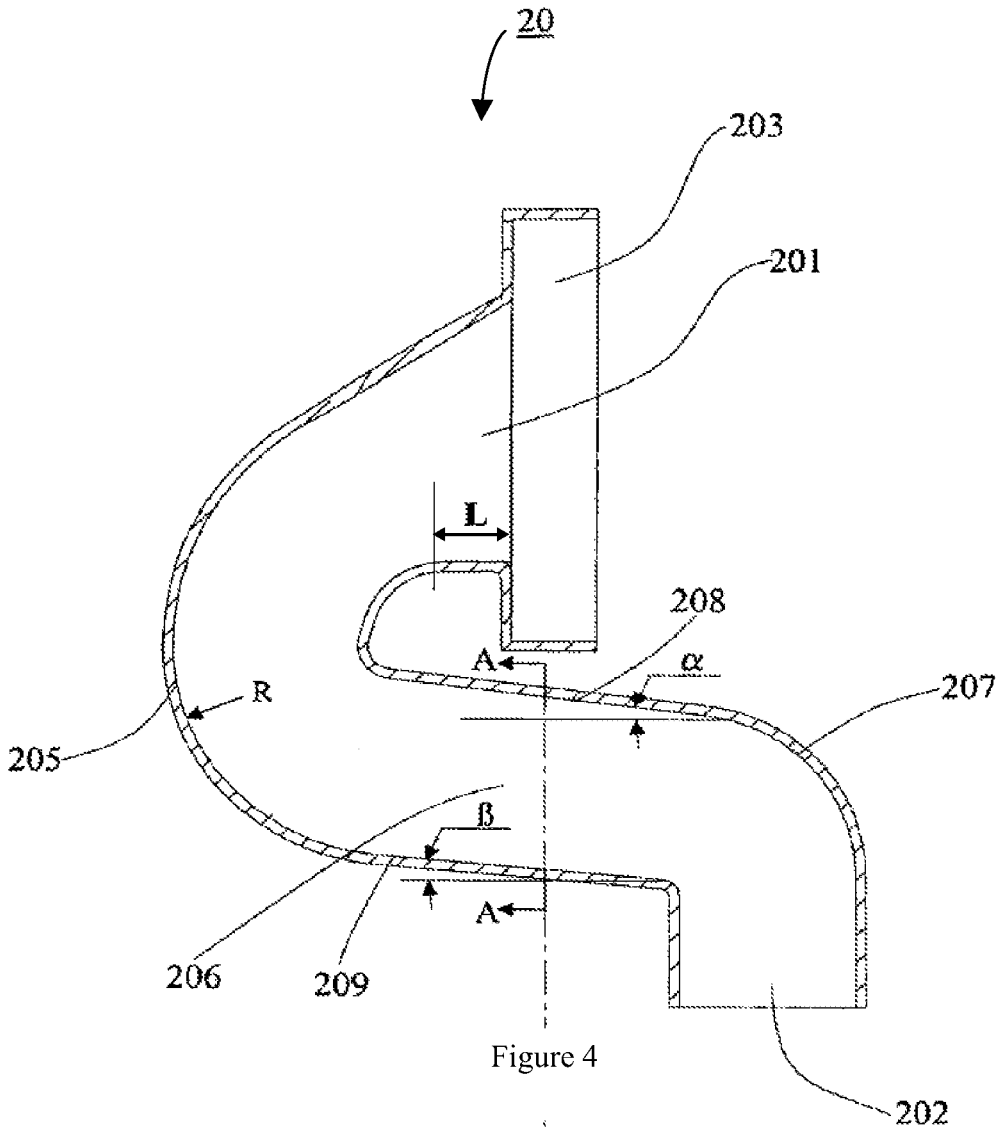
FIG. 4 is a sectional view of a connection device between a toilet and a drainpipe trap.

See FIG. 3 and FIG. 5. After installation, the trap 20 bends and extends from the flush port 16 of the toilet 1. The trap 20 basically has an even ring section along its length, and this section occurs at least at the outlet 202 close to the trap 20 (see the A-A section line in FIG. 4). The lower pipe wall of the inlet 201 of the trap 20 extends backwards from the flush port 16 of the toilet 1 horizontally for a distance "L" (20-45 mm optimally), and its upper pipe wall has a declining structure which extends backwards to a first bend 205. The optimal radius R of the first bend 205 is 45-65 mm. A lower pipe part 206 extends straightly from the first bend 205 to a second bend 207. The second bend 207 points to the outlet 202 and bends by 90 degrees downwards. Optimally, an upper inner pipe wall 208 and a lower inner pipe wall 209 of the lower pipe part 206 have a declination angle "a" of 2-7 degrees and a declination angle "β" of 0-5 degrees respectively to eliminate or reduce the generation of cavitation (without drawing) that may influence the siphon effect of the trap 20, so that the water from the toilet 1 can fill up the entire trap 20 rapidly. The basically even ring section of trap 20 helps to realize this effect. The optimal section inner diameter D is 52-56 mm.

As mentioned above, the connection device 2 between a toilet and a drainpipe simplifies the complex structure of an existing toilet 1 for on-site installation and for reliable use; the separated trap 20 design includes structure that can generate a siphon phenomenon. At the time of sale, wash-down drainage can be easily transformed to siphon wash-down drainage just by changing parts, such as the trap of the toilet, thus improving the drainage effect. The connection device 2 between a toilet and a drainpipe can also be applied to a siphon toilet.

We claim:

1. A connecting apparatus for making a connection between a flushing port and a drainpipe, comprising:

a trap-way piece forming a passage comprising an entrance configured to be in fluid communication with the flushing port; and an exit configured to be in fluid communication with the drainpipe;

wherein the trap-way piece comprises a first curved pipe portion, a second curved portion, and a transverse low pipe portion provided between the first and second curved portions, the transverse low pipe portion having a central axis;

wherein an upper part of an inner wall of the transverse low pipe portion extends with a different down angle than a lower part of the inner wall of the transverse low pipe portion, the upper and lower parts of the inner wall being disposed on opposing sides of the central axis of the transverse low pipe portion such that the upper part is provided above the lower part in a vertical direction when the connecting apparatus is connected between the flushing port and the drainpipe; and wherein the entrance comprises a flange containing a cavity connected and held together with the flushing port by a washer that is at least partially disposed inside the cavity and is compressed by an elongated fastener.

2. The connecting apparatus according to claim 1, wherein the trap-way piece has a symmetrical ring-shaped cross-section.

3. The connecting apparatus according to claim 2, wherein the diameter range of the ring-shaped cross-section is between 52 and 56 mm.

4. The connecting apparatus according to claim 1, wherein the radius range of the first curved pipe portion is between 45 and 65 mm.

5. The connecting apparatus according to claim 1, wherein the upper part of the inner wall incline is between about 2 and 7 degrees.

6. The connecting apparatus according to claim 1, wherein the lower part of the inner wall incline is between about 0 and 5 degrees.

7. The connecting apparatus according to claim 1, further comprising a washer cover, wherein the flange containing cavity, the washer, and the washer cover are configured to receive the flushing port; and wherein the fastener is configured to press the washer cover against the washer.

8. The connecting apparatus according to claim 1, further comprising a sealing member between the drainpipe and the exit.

9. The connecting apparatus according to claim 8, wherein the sealing member comprises a sealing ring and a sealing ring cover.

10. The connecting apparatus according to claim 8, wherein the sealing member comprises elastic material.

11. A device for connecting a toilet to a drainpipe comprising:

a trap having an inlet, an outlet, and a cavity provided proximate the inlet;

a washer comprising an elastic material;

a washer cover; and a threaded fastener for coupling the washer cover to the device;

wherein the cavity receives at least a portion of the washer, the washer is configured to receive at least a portion of a flush port of the toilet, and the threaded fastener compresses the washer between the trap and washer cover to seal a connection between the trap and the flush port when the threaded fastener is tightened.

12. The device of claim 11, wherein an inner diameter of the washer is approximately equal to or smaller than an outer diameter of the flush port.

13. The device of claim 11, wherein the washer is configured to be pressed between the cavity and the washer cover by the threaded fastener in a direction generally parallel with an axis of the flush port.

14. The device of claim 11, wherein the washer cover is configured to be disposed generally between the cavity and the toilet.

15. The device of claim 11, wherein the trap includes a first bend extending from the inlet, a lower pipe portion extending from the first bend, and a second bend extending from the lower pipe portion to the outlet.

16. The device of claim 15, wherein the lower pipe portion includes an upper wall having a declination angle of between approximately 2 and 7 degrees and includes a lower wall having a declination angle of between approximately 0 and 5 degrees.

17. The device of claim 15, wherein the first bend has a radius of between approximately 45 and 65 mm.

18. The device of claim 15, wherein a lower wall of the inlet extends generally horizontally between approximately 20 and 45 mm to the first bend.

19. The device of claim 18, wherein an upper wall of the inlet declines to the first bend.

20. A device for connecting a toilet to a drainpipe comprising:

a trap having an outlet and a flange forming an inlet, the flange having an end face;

a washer cover removably coupled to the end face by a threaded fastener; and a washer provided within a cavity formed by the flange and the washer cover, the washer being made of an elastic material and having an opening therein to receive a portion of a flushing port of the toilet;

wherein tightening of the fastener moves the washer cover toward the flange to compress the washer to tighten the sealing connection formed between the washer and the flushing port.

21. The connecting device of claim 20, further comprising a sealing member between the drainpipe and the outlet.

22. The connecting device of claim 21, wherein the sealing member comprises a sealing ring and a sealing ring cover.

* * * * *